US005973445A

United States Patent [19]

Watkins

[11] Patent Number: 5,973,445

[45] Date of Patent: Oct. 26, 1999

[54] DEVICE AND METHOD FOR EFFICIENT POSITIONING OF A GETTER

[75] Inventor: Charles Martin Watkins, Meridian, Id.

[73] Assignee: Micron Technology, Inc., Boise, Id.

[21] Appl. No.: 09/241,197

[22] Filed: Feb. 1, 1999

Related U.S. Application Data

[63] Continuation of application No. 08/535,849, Sep. 28, 1995, Pat. No. 5,865,658.

[51] Int. Cl.[6] ..... H01J 1/30

[52] U.S. Cl. ..... 313/309; 445/41

[58] Field of Search ..... 313/309, 495; 445/24, 25, 41

[56] References Cited

U.S. PATENT DOCUMENTS

| | | | |
|---|---|---|---|
| 3,870,917 | 3/1975 | Curry | 313/105 |
| 3,926,832 | 12/1975 | Barosi | 252/181.6 |
| 4,297,082 | 10/1981 | Wurtz et al. | 417/51 |
| 4,312,669 | 1/1982 | Boffito et al. | 75/177 |
| 4,743,797 | 5/1988 | Emberson et al. | 313/422 |
| 4,789,309 | 12/1988 | Giorgi | 417/51 |
| 4,839,085 | 6/1989 | Sandrock et al. | 252/181.6 |
| 4,874,339 | 10/1989 | Bratz | 445/28 |
| 4,940,300 | 7/1990 | Giorgi | 313/558 |
| 4,977,035 | 12/1990 | Travis et al. | 428/550 |
| 5,057,047 | 10/1991 | Greene et al. | 445/24 |
| 5,060,051 | 10/1991 | Usuda | 257/765 |
| 5,207,607 | 5/1993 | Nagano et al. | 445/24 |
| 5,233,766 | 6/1993 | Nakayama et al. | 313/309 X |
| 5,283,500 | 2/1994 | Kochanski | 313/309 X |
| 5,469,014 | 11/1995 | Itoh et al. | 313/309 X |
| 5,520,563 | 5/1996 | Wallace et al. | 445/24 |

FOREIGN PATENT DOCUMENTS 2-295032 12/1990 Japan .

OTHER PUBLICATIONS

Giorgi, E. and Ferrario, B., *IEEE Transaction on Electron Devices*, vol. 36, No. 11 Nov. 1989, "High–Porosity Thick–film Getters," pp. 2744–2747.

Giorgi, T.A., Ferrario, B., and Storey, B., *J. Vac. Sci. Technol*, A3 (2) Mar./Apr. 1985, "An updated review of getters and gettering," pp. 417–423.

Saes Getters S.p.A., *ST 171 Non–Evaporable Porous Getters*.

Saes Getters S.p.A., *ST 175 Non–Evaporable Porous Getters*, pp. 1–5, Figs. 1–6.

Borghi, M., Dr., *ST 121 and ST 122 Porous Coating Getters*, New Edition Nov. 19, 1992, Original Jul. 1987, pp. 3–13.

Carella, S., Boffito, C., and Carretti, C., "Gettering in Small Size Vacuum Microelectronic Devices".

Giorgi, T.A., *Proc. 6th Internl. Vacuum Congr. 1974 Japan J. Appl. Phys. Suppl. 2,PT. 1974*, "Getters and Gettering," pp. 53–60.

Giorgi, E., and Ferrario B., "High Porosity Thick Film Getters," pp. 1–10, Figs. 1–8, and References.

*Primary Examiner*—Kenneth J. Ramsey

*Attorney, Agent, or Firm*—Hale and Dorr LLP

[57] ABSTRACT

A FED is provided comprising: an emitter located on a cathode; a pixel located on an anode positioned to receive electrons from the emitter; and a getter located on the anode. According to another aspect of the invention, a method of making an FED is provided comprising: depositing getter material over a tip on a cathode; assembling the cathode with an anode, wherein the getter is between the tip and the anode; and activating the getter, whereby the activation causes the getter to be deposited on the anode.

8 Claims, 6 Drawing Sheets

DEVICE AND METHOD FOR EFFICIENT POSITIONING OF A GETTER

CROSS-REFERENCE TO RELATED APPLICATION

This application is a continuation of Ser. No. 08/535,849 filed Sep. 28, 1995, now U.S. Pat. No. 5,865,658.

BACKGROUND OF THE INVENTION

This invention relates to flat panel displays and more specifically to positioning of getters in field emission devices ("FEDs"), examples of which are seen in U.S. Pat. Nos. 3,665,241; 3,755,704; 3,812,559; and 5,064,396, all of which are incorporated herein by reference.

In the use of FEDs, where there is a vacuum between and electron emitter and an anode, gas molecules are released which can cause operational problems (for example, see U.S. Pat. Nos. 5,223,766; and 4,743,797, incorporated herein by reference). Thus, a material commonly known as a "getter" is inserted in the vacuum space, for example on the side of the area between the emitter on the cathode and the phosphor on the anode. Common getter materials include titanium and other highly reactive materials. These materials react with the molecules generated during operation, preventing the molecules from causing voltage breakdown within the device.

However, the placement of the getter on the side increases the width of the display. Further, activation of the getter by heating or passing a current through the getter causes evaporation or sublimation of the getter material. Since the getter material is, at least in some cases, conductive, deposition of the material on the cathode or grid of the FED could cause shorts or otherwise adversely effect the operation of the device. Therefore, various bulky methods, such as shields, have been devised to isolate the getter from the cathode and grid. Therefore, during the evaporation or sublimation, the getter material will deposit on non-active elements in the vacuum space. Unfortunately, however, this results in the getter being placed in areas remote from the very location where molecules are generated—namely, the cathode, grid and anode.

Therefore, there is a need for a method and device for placement of a getter in an FED wherein the activation of the getter does not cause a deposit of conductive material on the grid or cathode, wherein the getter is near the locations where molecules are generated, and without the extra space and bulk used in previous devices and methods.

It is an object of the present invention to fulfill those needs.

SUMMARY OF THE INVENTION

According to one aspect of the invention, a FED is provided comprising: an emitter located on a cathode; a pixel located on an anode positioned to receive electrons from the emitter; and a getter located on the anode.

According to another aspect of the invention, a method of making an FED is provided comprising: depositing getter material over a tip on a cathode; assembling the cathode with an anode, wherein the getter is between the tip and the anode; and activating the getter, whereby the activation causes the getter to be deposited on the anode.

DESCRIPTION OF THE DRAWINGS

For a more complete understanding of the present invention and for further advantages thereof, reference is made to the following Detailed Description taken in conjunction with the accompanying drawings, in which.

It is to be noted, however, that the appended drawings illustrate only typical embodiments of this invention and are therefore not to be considered limiting of its scope, for the invention may admit to other equally effective embodiments.

DETAILED DESCRIPTION

Figure 1:
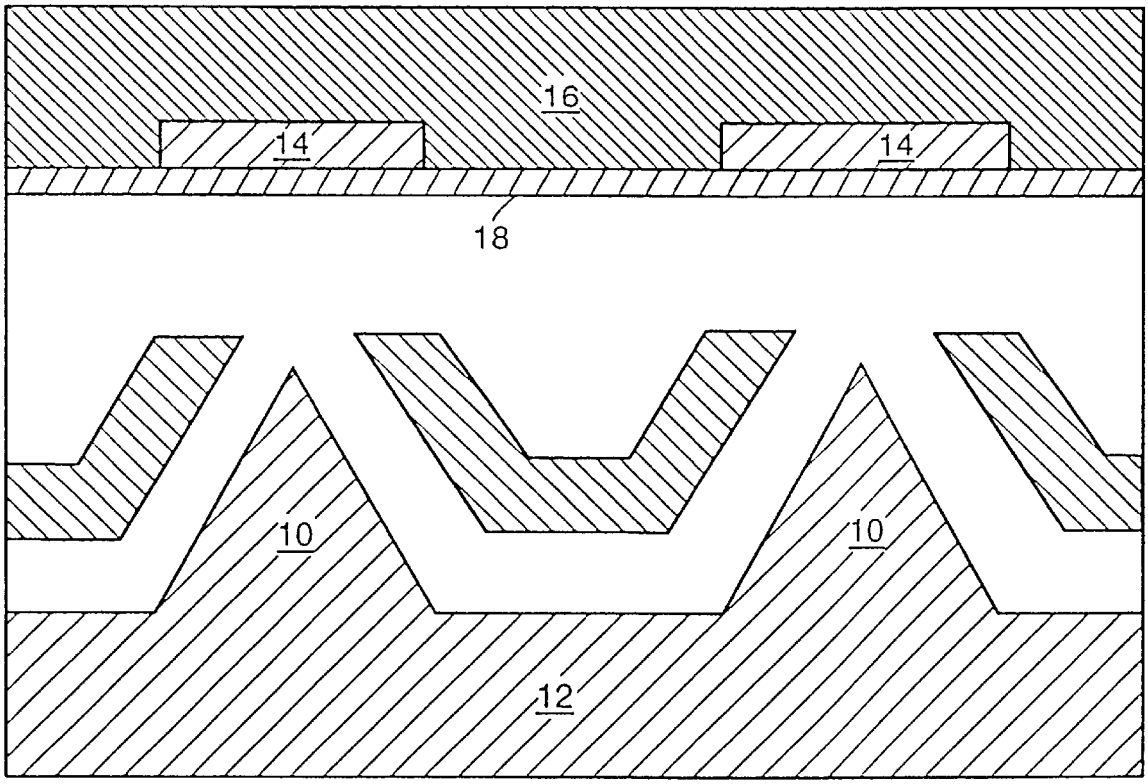
FIGS. 1 and 2 are cross-sectional vies of an FED according to an embodiment of the present invention.

Referring now to FIG. 1, an example FED of the invention is shown. As those of skill in the art will recognize, what is seen is a representational view of a portion of a pixel of an FED, each pixel having multiple emitters, although one pixel per emitter is also within the scope of the invention. Two such emitters (10) are seen in FIG. 1, formed integrally on a cathode (12); a phosphor (14) on an anode (16). The phosphor (14) is positioned with respect to the anode (16) to receive electrons from the emitter (10). Between the phosphor (14) and the emitter (10) is the getter (18). According to this example, the getter (18) comprises a few monolayers of getter material, thin enough to allow electrons from emitter (10) to cause phosphor (14) to emit light through the anode (14). The getter may comprise a monolayer of getter material on the phosphor, or may comprise a plurality of monolayers on the phosphor.

It will be understood that FIG. 1 is representational only, is not to scale, and does not disclose other layers of cathode (12) or anode (16) that are used in various embodiments of the device but are not the focus of the present invention. Those of skill in the art will, nevertheless, understand the manufacture of various devices using the present invention.

Figure 2:
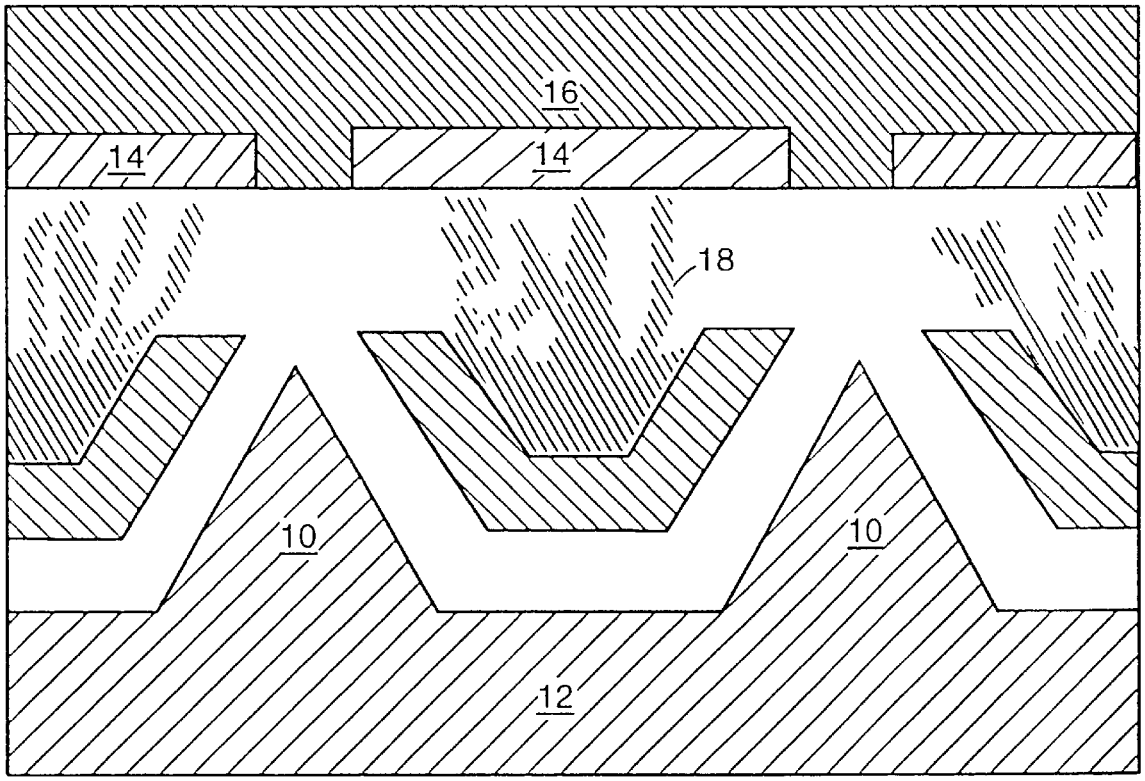

Referring now to FIG. 2, in making an FED according to the present invention, an acceptable method comprises depositing getter material (18) over a cathode (12); assembling the cathode (12) with an anode (16). After assembly, the getter (18) is activated, causing the getter (18) to be deposited on the anode (16).

Figure 3:
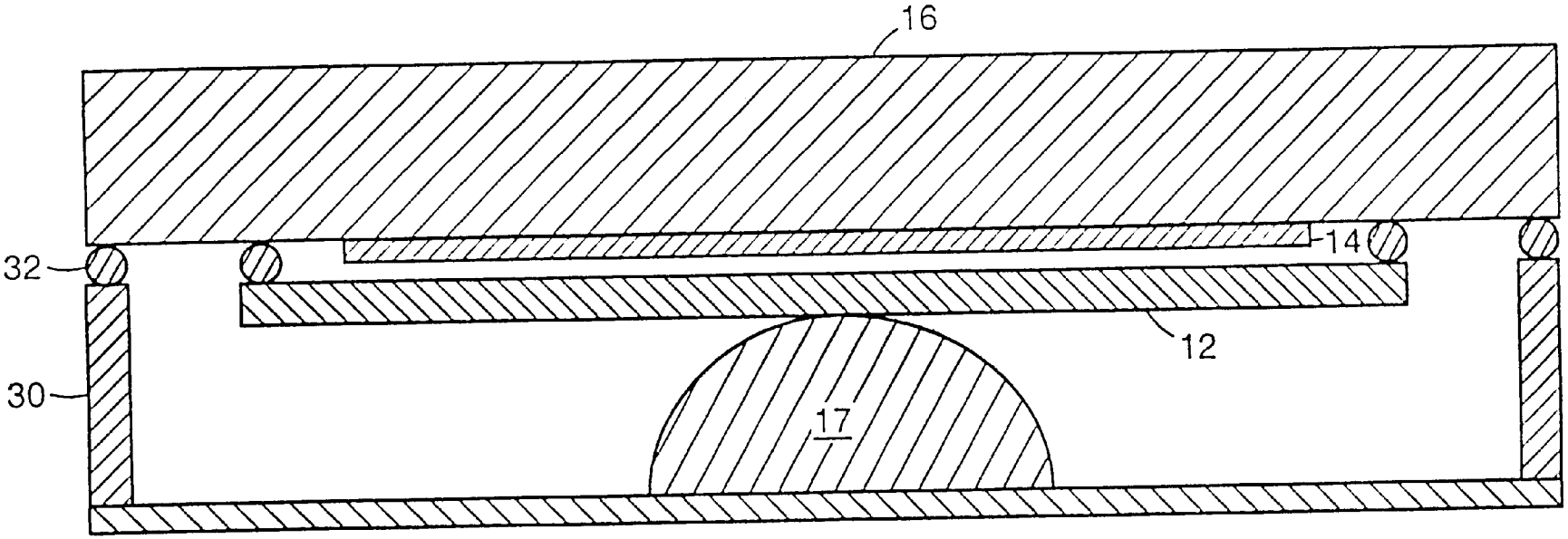
FIG. 3 is a cross-sectional view of a sealed anode and cathode.

According to one acceptable process, the activating comprises heating the assembled cathode and anode. According to one method, as seen in FIG. 3, the anode and cathode are sealed in glass (30), which is sealed by heating a glass frit (32). The getter material (18) is chosen to activate at a temperature at or below the temperature at which the frit seals. Acceptable frits are matched with the glass from a thermal expansion aspect. Also seen in FIG. 3 is support (17), which comprises frit of the same material as frit seal 32.

Acceptable getter materials include any of the known getter materials, for example: titanium barium, zirconium, calcium, magnesium, strontium.

According to an alternative method, the sealing occurs after the activating.

Figure 4:
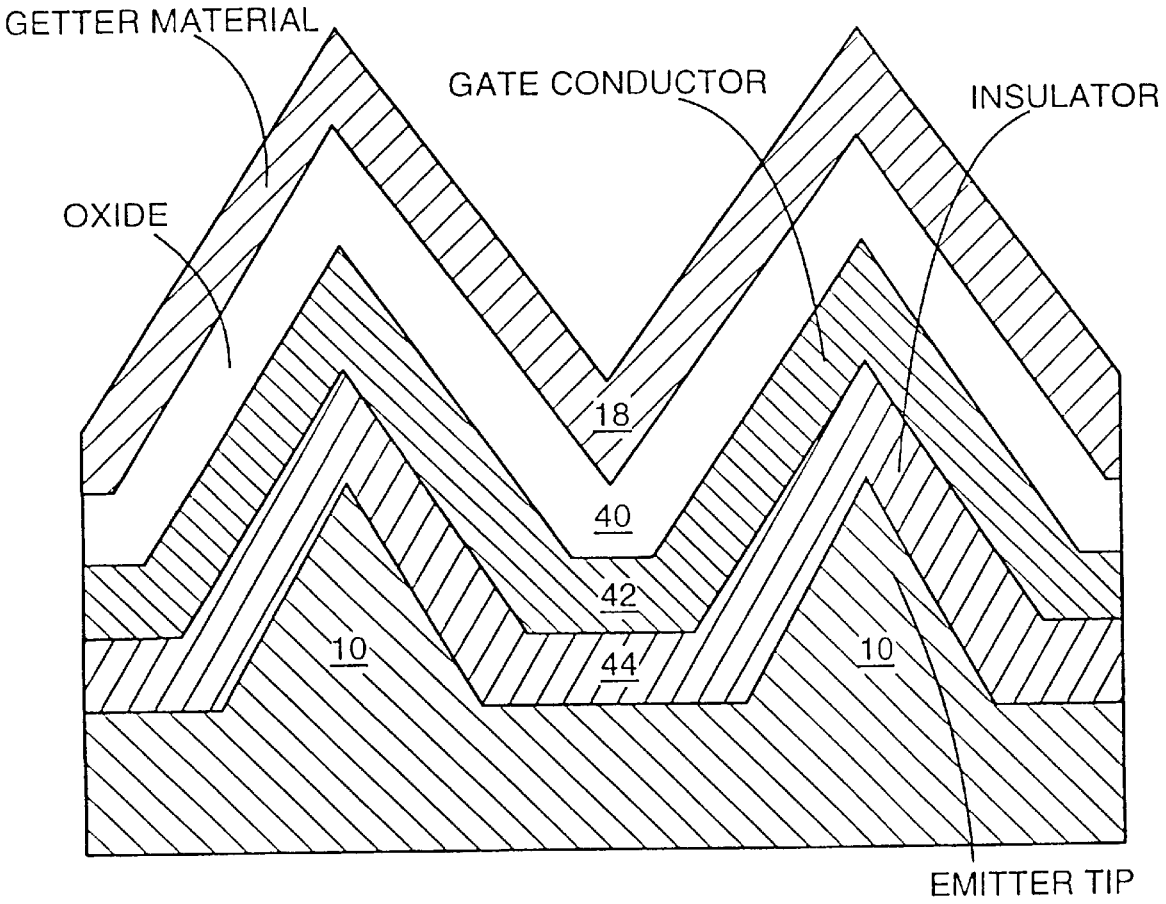
FIGS. 4 and 5 are cross-sectional views illustrating a first method for forming a getter on a cathode.

Referring now to FIG. 4, a method of deposition of the getter (18) is shown in which, in succession, an insulator (44) (for example, silicon dioxde) is formed over the emitter tip (10), a gate conductor (42) (for example, aluminum) is formed over the insulator (44), an oxide (40) is formed over the gate conductor (42), and a getter material layer (18) is formed over the oxide (40). Acceptable methods of forming of the layers will occur to those of skill in the art.

Figure 5:
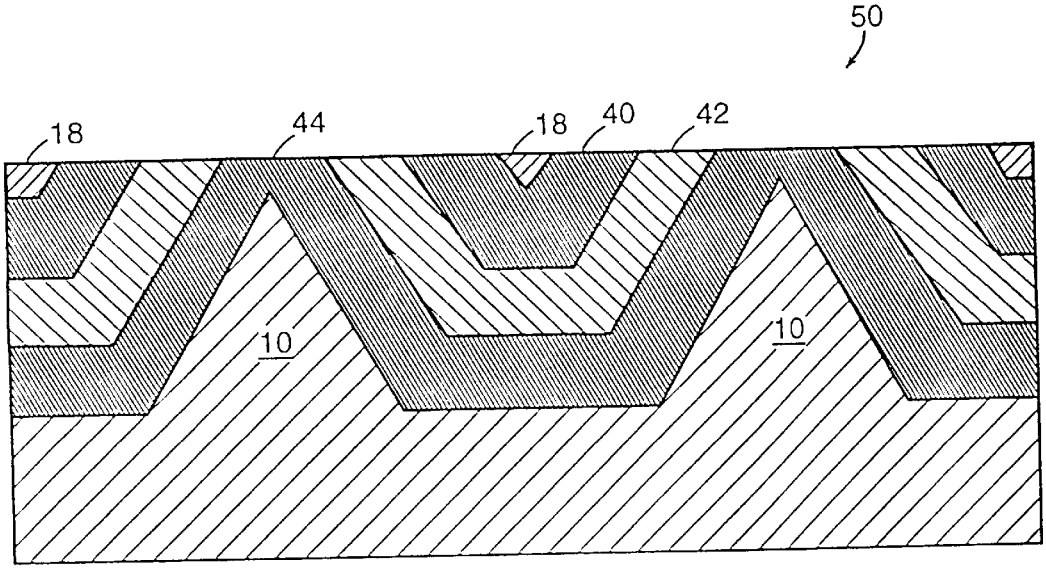

As seen in FIG. 5, chemical/mechanical planarization, a process understood by those skilled in the art, provides a getter material 18 in the oxide (40) over conductor (42). After selective etching to expose emitter (10) from under insulator (44), the emitter assembly (50) is assembled as seen in FIG. 3, and getter material (18) is activated.

Figure 6:
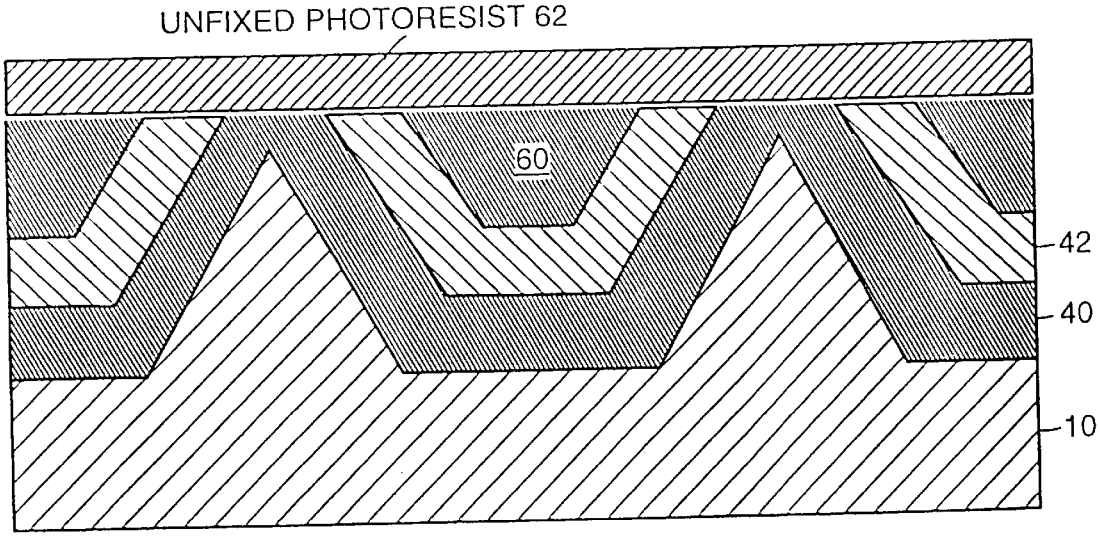
FIGS. 6 and 7 are cross-sectional views of a second method for forming a getter over a cathode.
Figure 7:
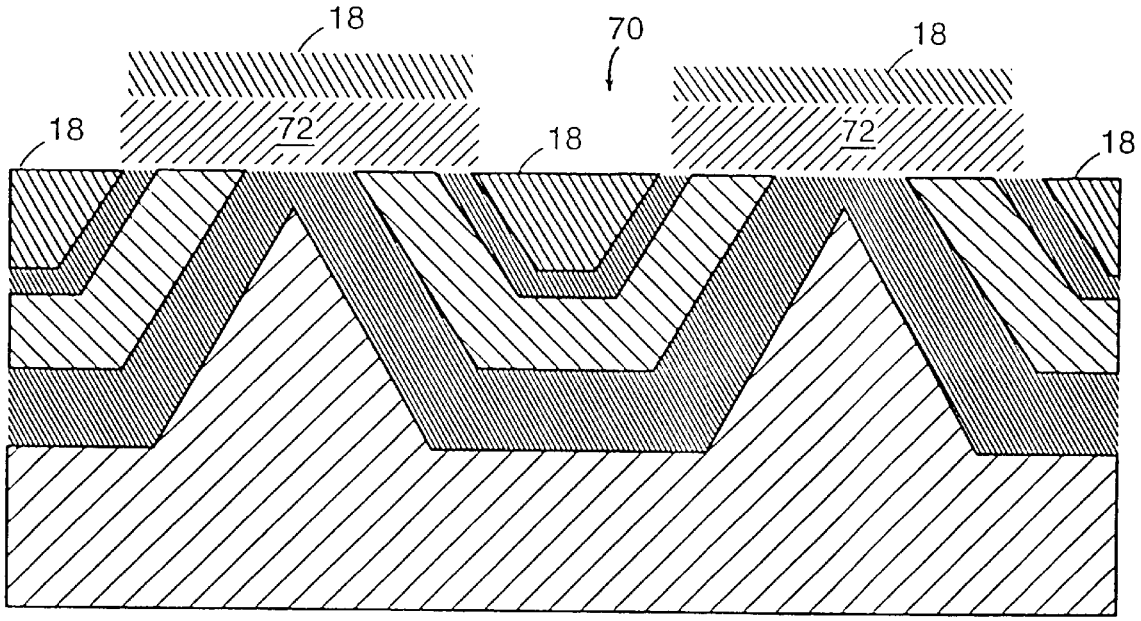

Referring now to FIG. 6, an alternative embodiment is seen, in which a thick layer of oxide (60) is deposited and then chemical/mechanical planarization is carried out. Next, unfixed photoresist (62) is deposited, as shown. Then, as seen in FIG. 7, a portion of the photoresist over emitter (10) is fixed and the unfixed portion is removed to form fixed photoresist (72). Next, the oxide (40) is etched to form depression (70), into which getter material (18) is deposited by, for example, sputter, chemical vapor deposition, or other processes that will occur to those of skill in the art. The fixed photoresist is then removed along with any getter material that is on the fixed photoresist 72. Again, selective etch of the insulator (44) exposes the gate and emitter.

According to alternative embodiments, the getter material is deposited directly on the gate material, without any oxide between.

What is claimed is:

1. A method for making an FED comprising:

providing a getter material over a cathode that has a plurality of emitters;

positioning the cathode next to an anode; and heating the cathode and anode to seal the anode and cathode together and so that the getter material deposits on the anode and is activated while the anode and cathode are sealed.

2. The method of claim 1, wherein the heating is done with a sealing material between the anode and cathode so that the seal is hermetic.

3. The method of claim 1, wherein the providing includes providing an insulating layer over a conductive gate layer, and providing the getter over the insulating layer.

4. The method of claim 1, comprising, prior to the providing, forming conically shaped emitter tips in the cathode, forming a first insulator around the tips, forming a conductive gate over the first insulator, forming a second insulator over the gate layer, and providing the getter in selected regions between the emitter tips over the gate layer.

5. A display device comprising:

a number of generally conical emitters;

an insulating layer over the emitters and over regions between the emitters;

a conductive layer over the insulating layer;

a dielectric layer over the conductive layer; and a layer of getter material over the dielectric layer.

6. The display device of claim 5, wherein the getter material is formed in separate locations on the dielectric layer between emitters.

7. The display device of claim 5, wherein the display device is in an intermediate assembly form and the getter material is formed over the dielectric layer such that if planarized, the getter would remain in discrete locations between emitters.

8. A method for making a display device comprising:

forming a number of generally conical emitters;

forming an insulating layer over the emitters and over regions between the emitters;

forming a conductive layer over the insulating layer;

forming a dielectric layer over the conductive layer; and forming a layer of getter material over the dielectric layer.

* * * * *